US006050210A

United States Patent [19]

Grzybowski

[11] Patent Number: 6,050,210

[45] Date of Patent: Apr. 18, 2000

[54] UNIVERSAL CLAMPING SYSTEM

[76] Inventor: Joseph Michael Grzybowski, 9 Van Buren Rd., Scotia, N.Y. 12302

[21] Appl. No.: 09/337,478

[22] Filed: Jun. 21, 1999

Related U.S. Application Data

[63] Continuation of application No. PCT/US99/01773, Jan. 30, 1998.

[30] Foreign Application Priority Data

Jan. 30, 1998 [GB] United Kingdom ..... 98018948

[51] Int. Cl.[7] ..... B63B 43/14

[52] U.S. Cl. ..... 114/123

[58] Field of Search ..... 114/123, 343, 114/344, 347, 364

[56] References Cited

U.S. PATENT DOCUMENTS

| | | | |
|---|---|---|---|
| 655,234 | 8/1900 | Howe et al. | 114/123 |
| 4,641,594 | 2/1987 | Birkett | 114/43 |
| 4,862,818 | 9/1989 | Sullivan | 114/347 |
| 5,295,454 | 3/1994 | Streck | 114/123 |
| 5,501,169 | 3/1996 | Denker | 114/364 |
| 5,829,376 | 11/1998 | Kostanski | 114/61 |

*Primary Examiner*—Jesus D. Sotelo
*Attorney, Agent, or Firm*—Ourpal (R) Asija

[57] ABSTRACT

This invention comprises methods, devices and systems for clamping an outrigger to a watercraft. More particularly it comprises a locking clamp for securing mounting brackets and accessory mounts to T shaped or inverted L shaped gunwales of watercraft. A portable, heavy-duty and versatile mounting bracket can be easily constructed utilizing this clamp.

5 Claims, 12 Drawing Sheets

UNIVERSAL CLAMPING SYSTEM

RELATED DOCUMENT

This application is a continuation of PCT application Ser. No. PCT/US99/01773 and a United Kingdom national application 98018948 GB filed Jan. 30, 1998.

BACKGROUND

This invention relates to methods, device and systems for clamping an outrigger to a watercraft. More particularly it relates to a locking clamp for securing mounting brackets and accessory mounts to T shaped or inverted L shaped gunwales of watercraft. A portable, heavy-duty and versatile mounting bracket can be easily constructed utilizing this clamp.

THE PROBLEM

The problems with prior art clamping systems for boats include:

a) Not lockable b) Not durable c) Not affordable d) Not universal

SUMMARY

This invention relates to a portable, articulated, heavy-duty and versatile mounting bracket which can be rapidly mounted and dismounted on a small watercraft. More particularly it comprises a positive grip, locking clamp for securing mounting brackets and accessory mounts to T-shaped or inverted L-shaped gunwales of watercraft.

PRIOR ART

Small watercraft are well known and versatile vessels, most of which possess several characteristics which are attractive to users. Most of them are inexpensive compared to other watercraft, are compact, man-powered and small-engine powered, and lightweight. They are also readily transportable overland on motor and other vehicles ard, if need be, by hand.

Small watercraft are manufactured in many basic configurations, and it is often necessary to modify them to suit specific purposes by mounting special accessories on suitably designed mounting brackets.

Existing mounting brackets are typically clamped to the port and/or starboard gunwale, or a manufacturer provided thwart, or the hull is permanently altered to fix the mounting bracket at one position on the hull to achieve a measure of structural stability of the accessory and the small watercraft.

Permanent alterations to the hull are not normally desirable in small watercraft owing to the inflexibility of the mounting position of the accessory on the hull, and also the additional weight of the stiffeners utilized for additional structural support of the hull about the mounting point. Existing mounting brackets provide little independent structural support to the accessory and the small watercraft.

A large proportion of modern small watercraft are constructed with a T-shaped gunwale, typically aluminum. A substantial number of existing mounting brackets do not provide substantial surface area clamping to both the inner and outer T-shaped gunwale edges, hence, under hazardous conditions, stresses at these points can be high. Thus, the clamps utilized to fix the mounting bracket to the small watercraft may become detached, accidentally or inadvertently, at a critical juncture with possible catastrophic consequences. The inverted L-shaped gunwales that are used on some small watercraft are constructed of aluminum, wood, or engineering plastic structural shapes. Although they all vary slightly in dimensions, they may be fitted with a properly designed, heavy-duty clamp to fix a mounting bracket on the small watercraft.

A prior art patentability search was commissioned and conducted by the inventor. Furthermore the inventor is intimately familiar with the prior art.

Following is a listing of the typical prior art arranged in the reverse chronological order for ready reference of the reader.

a) U.S. Pat. No. 5,829,376 awarded to Jerzy Kostanski on Nov. 3, 1998 for "Outrigger Watercraft"

b) U.S. Pat. No. 5,501,169 showered upon James Denker on Mar. 26, 1996 for "Universal Canoe Accessory Mounting Bracket"

c) U.S. Pat. No. 5,295,454 granted to Donald Streck on Mar. 22, 1994 for "Safety Release Outrigger Attachment for an Outrigger Canoe"

d) U.S. Pat. No. 4,641,594 honorably issued to Harry Birkett on Feb. 10, 1987 for "Canoe Conversion Kit"

Unfortunately none of the prior art devices singly or even in combination provide all of the features and objectives established by the inventor for this system as enumerated below.

OBJECTIVES

1. It is an objective of this invention to provide method, devices and system for a universal locking clamp for securing mounting brackets and accessory mounts to T-shaped or inverted L-shaped gunwales of all types of water craft.

2. Another objective of this invention is to provide a universal clamping system suitable for all types and sizes of watercraft.

3. Another objective of this invention is that it be light weight.

4. Another objective of this invention is that it be long lasting, reliable made with heavy duty components.

5. Another objective of this invention is that the clamp of this invention provide positive grip lock.

6. Another objective of this invention is that it use little or no additional power or energy.

7. Another objective of this invention is that it is easy to use even for novices and beginners and therefore requires little additional training.

8. Another objective of this invention is that the mounting system of this invention is integrated and streamlined.

9. Another objective of this invention is that it be physically safe in normal environment as well as accidental situations.

10. Another objective of this invention is that it be environmentally friendly.

11. Another objective of this invention is that it be made of modular units easily interface-able to each other.

12. Another objective of this invention is that it meet all federal, state, local and other private standards, guidelines and recommendations with respect to safety, environment, quality and energy consumption.

13. Another objective of this intention is that it be elegantly simple in concept and design.

14. Another objective of this invention is that it be applicable to the retrofit as well as OEM market.

15. Another objective of this invention is that it be easy to install, de-install, deploy, stow, transport and store.

16. Another objective of this invention is that it can be adapted for other uses.

17. Another objective of this invention is that it is easily separable from the watercraft in case of an emergency.

18. Other objectives of this invention reside in its simplicity, elegance of design, ease of manufacture, service and use and even aesthetics as will become apparent from the following brief description of the drawings and concomitant description.

BRIEF DESCRIPTION OF THE DRAWINGS

The objects, features, and advantages of the present invention and its application will be more readily appreciated when read in conjunction with the accompanying drawings, in which.

a)

b)

c)

d)

e)

f)

g)

i)

j)

k)

l)

m)

n)

DETAILED DESCRIPTION OF THE PREFERRED EMBODIMENT

Figure 1:
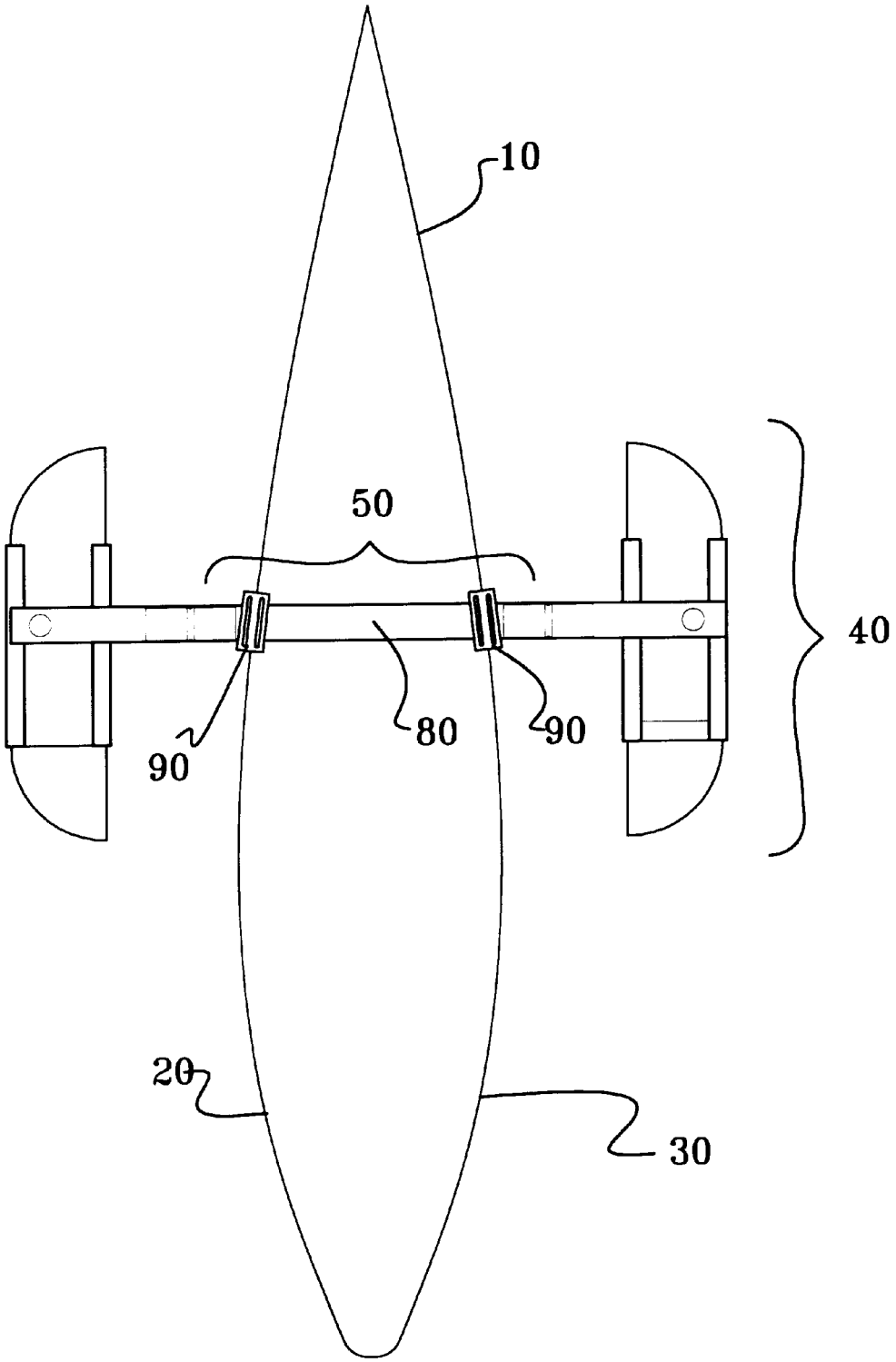
FIG. 1 shows a diagrammatic representation of an assembled, unitary flotation device fixed to a small watercraft.

The universal clamping system of this invention as shown in the various drawings wherein like numerals represent like parts throughout the several views, there is generally disclosed in FIG. 1.

According to the present invention there is provided a clamp which is lightweight, low profile, high stability, heavy-duty and lockable. Any material of suitable structural shape can be firmly and easily and rapidly fastened to the T-shaped or inverted L-shaped gunwales of small watercraft with these clamps. This in turn produces a portable, compact, light weight, possibly articulated, heavy-duty and versatile mounting bracket. Clamps such as the ones described herein, can be essential mounting hardware where watercraft stability and safety are concerned. The clamps and thus the mounting bracket can be easily mounted and removed even at substantially forward and aft hull locations.

The invention provides a mounting bracket (clamps and transverse support strut) which can add to the structural support of the small watercraft as well as the accessories fixed to it. The clamp featured in this invention provides positive, heavy-duty and rapid mounting and dismounting capabilities. Owing to the heavy-duty and positive grip nature of the clamps, the mounting bracket can be articulated in any suitable manner to accommodate the needs of a particular accessory.

The transverse support strut, with or without the attached and foldable outer strut arms, will act as a sturdy mount for accessories (e.g. floats, float units, engines, motors, wheels, multi-hull catamaran couplings and sailing conversion kits). Two or more accessories or ancillary hardware can be simultaneously fitted to a single mounting bracket, within acceptable stress limits on the mounting bracket, gunwale and hull, respectively. Accessories that generate high stresses, or are very bulky, can be securely fastened to a small watercraft utilizing two or more of the mounting brackets.

Typically the mounting bracket is securely fastened to the small watercraft with the prescribed clamps for use under moderate, or for short-duration extreme operating conditions. only a small portion of the transverse support strut need protrude beyond the side of the hull, thereby minimizing fouling possibilities with natural waterside obstructions.

An easy mount brush guard can be utilized to protect the outboard side of the clamp from foaling during use. The combined clamps and transverse support strut make this mounting bracket versatile enough to fit all small watercraft which possess a T-shaped gunwale. Furthermore slight variations of the clamp design will permit the mounting bracket to be used on gunwales that are of an inverted L-shape.

According to the present invention, there is also provided clamps that are of such a design that when totally engaged, they tend to align naturally, and force the lower clamping fixtures to remain engaged with the gunwale of the small watercraft, even if a clamp fastener subsequently becomes inadvertently loose. A suitable top alignment fixture is utilized to hold all components together and aligned. The lower clamping fixture, which provides the clamping force, can be a unit body construction (such as aluminum angle), an assembly of component parts, or can be adjustable to accommodate the different thicknesses of the clamping surface of different gunwales. A clamp-locking safety fixture can be fixed in any suitable manner to a mounting bracket or clamp component (such as the top alignment fixture, the lower clamping fixture, or the clamp fasteners) to prevent the clamp from detaching from the gunwale.

Clamp-locking safety fixtures ensure that the clamps remain engaged and aligned to maximize the safety margin. Owing to the clamp-locking safety fixtures, the pair of lower clamping fixtures cannot splay apart, or spread sufficiently to disengage from the gunwale.

The relevant clamp can, therefore, loosen and vibrate or shift, but it cannot disengage from the gunwale unless the clamp-locking safety fixtures are disengaged and the relevant clamp fasteners must in turn be sufficiently loose.

Normally, the vibration or shifting of the loose mounting bracket and accessory, will alert thus crew member to the presence of a problem, so that it will be remedied before any failure can occur.

This clamping system distributes the heaviest of loads over a substantially larger gunwale surface area than many existing devices, owing to the lower clamping fixtures, which is an especially valuable feature in rough waters. These clamps are unlikely to become detached other than during very severe conditions.

Several components (such as the transverse support strut, top alignment fixture, lower clamping fixture) can be fitted with an anti-slip surface to minimize slippage. The modified clamp design, which functions well on inverted L-shaped gunwales, possesses similar mechanical and safety features to the clamp designed for T-shaped gunwales.

This invention also provides a means in which outer strut arms attached to the mounting bracket are articulated or hinged and, therefore, can be folded and stowed in any desirable position relative to the small watercraft.

An outer strut arm is locked in the engaged configuration with a positive locking fastener such as a latch or a catch or according to the preferred embodiment of the invention, a locking strut, which permits the remote locking of the outer strut arm.

Virtually any reasonable type, size and shape of accessory can be rapidly and easily affixed to the mounting bracket or fold-able outer strut arms.

Specific embodiments of the present invention will now be described by way of example only and with reference to the accompanying drawings.

A small watercraft 10, to whose gunwales 20,30 a complete and totally assembled flotation device 40 is securely attached is illustrated in FIG. 1. This is an effective illustration of the versatile nature of the clamps 90 and mounting bracket 50 when it is mounted on a small watercraft 10 with an accessory fixed to it which can generate moderate to high levels of stress.

Figure 2:
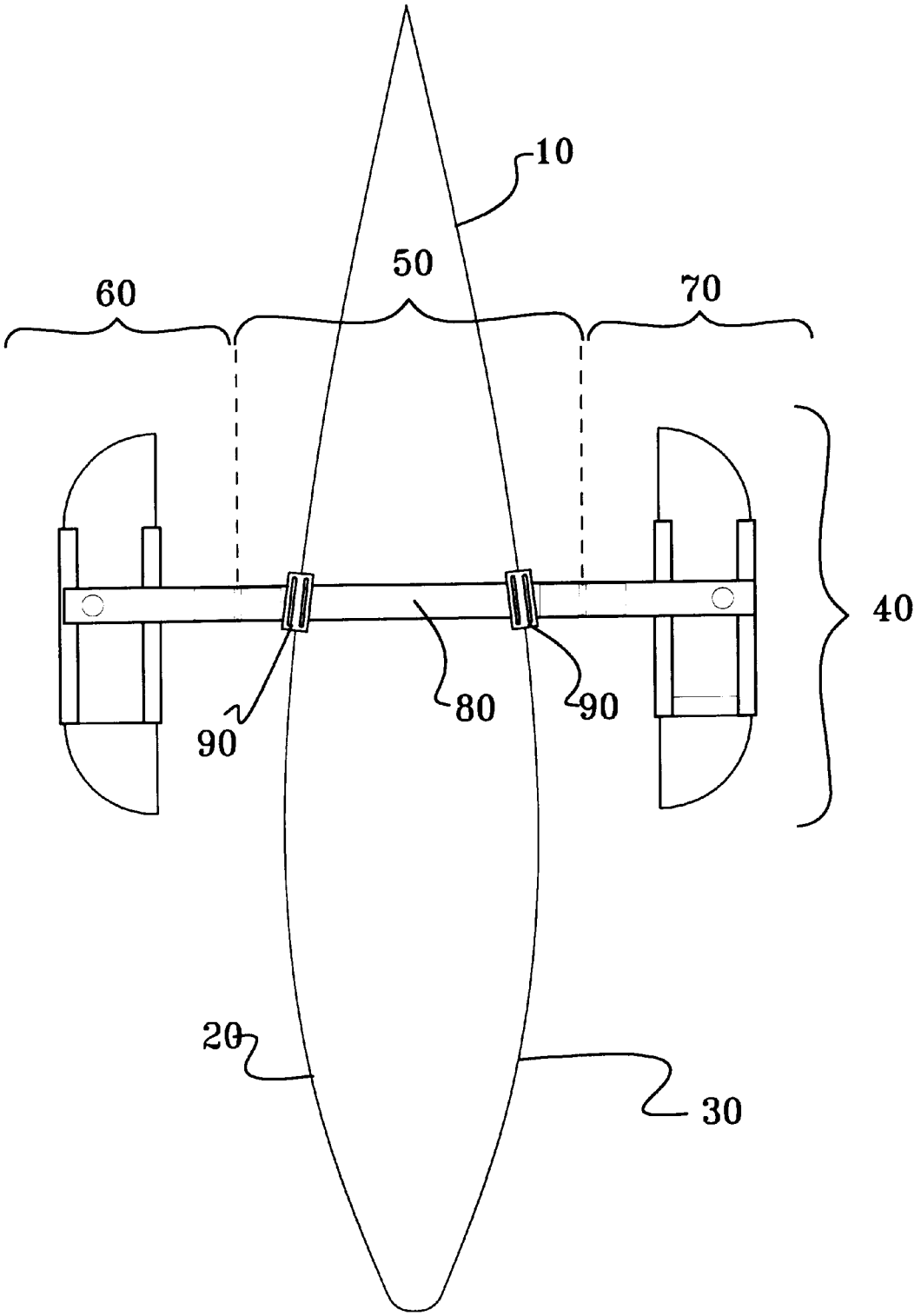
FIG. 2 shows a diagrammatic representation of a flotation device fixed to a small watercraft. A useful division of the mounted flotation device into three distinct segments is illustrated.
Figure 3:
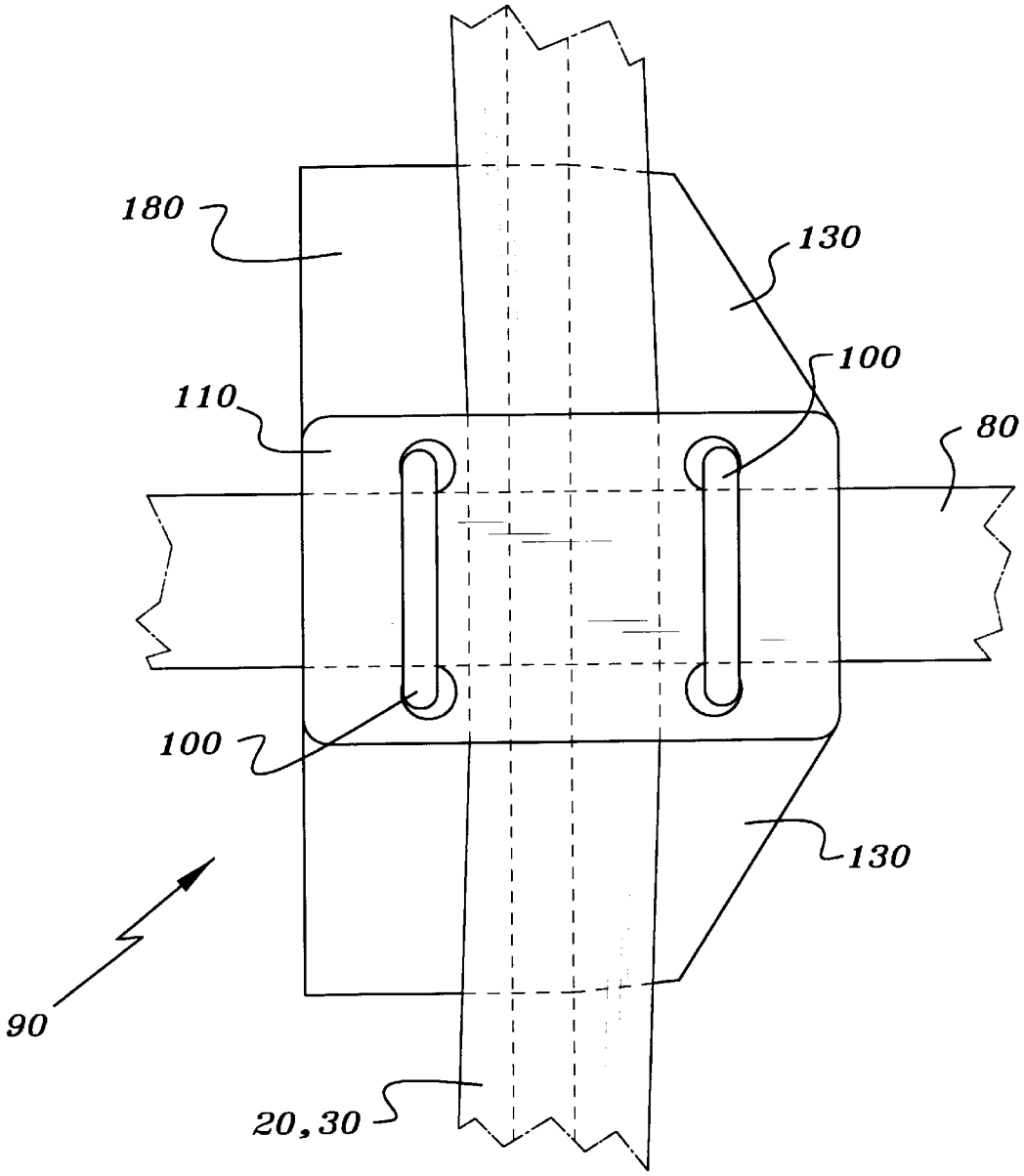
FIG. 3 shows a diagrammatic representation of an expanded top view of the clamp utilized to fix the transverse support strut to the T-shaped gunwale of a small watercraft.
Figure 4A:
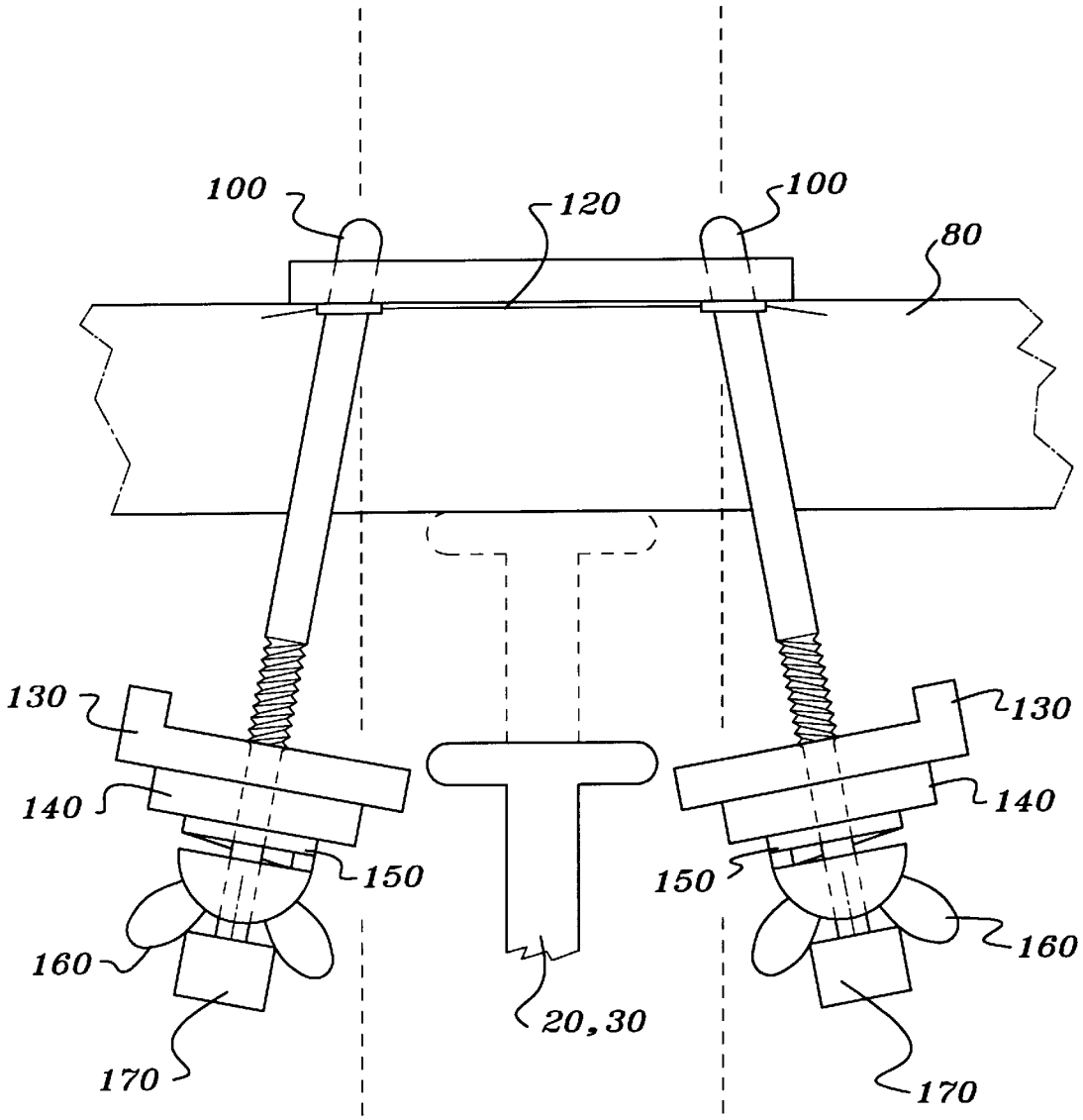
FIG. 4A shows a diagrammatic representation of an expanded view of the clamp utilized to fix the transverse support strut to the T-shaped gunwale of a small watercraft. The perspective is from the bow (or stern) of the craft. The mounting and dismounting technique is illustrated.
Figure 4B:
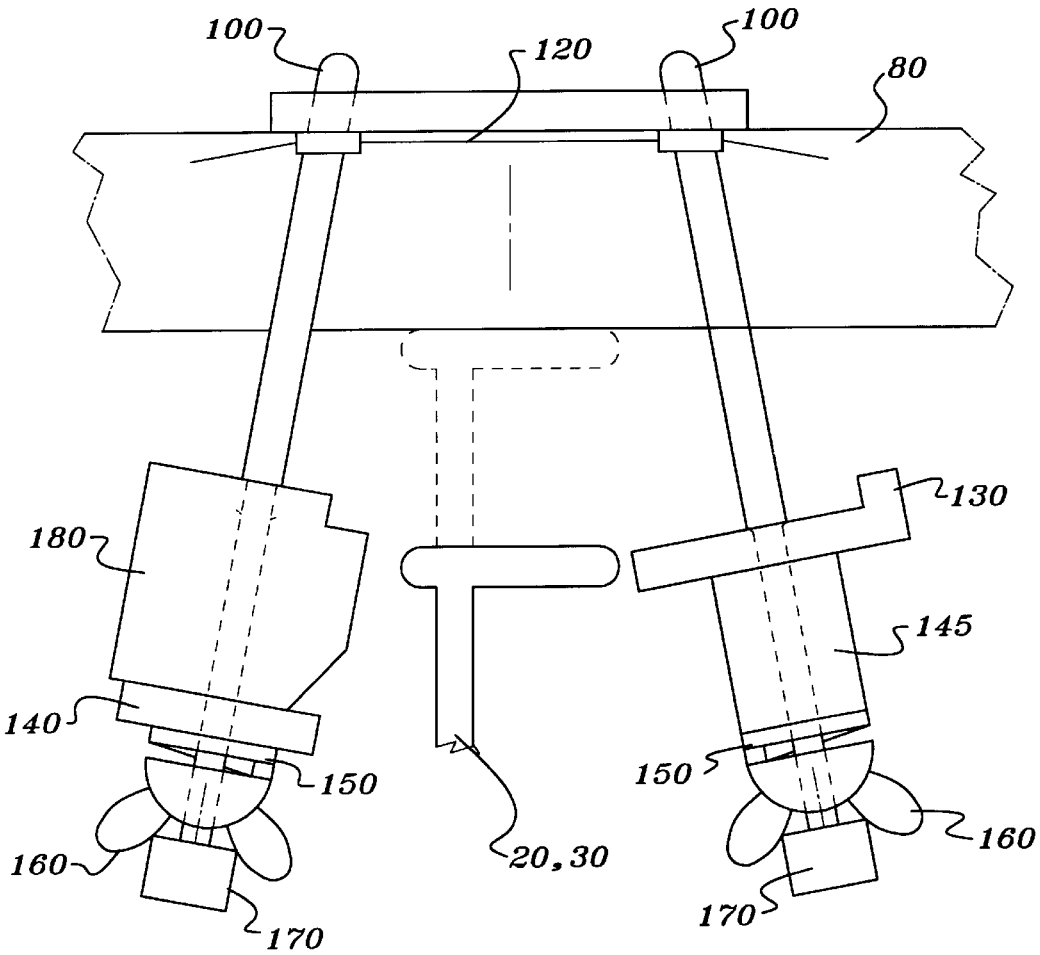
FIG. 4B shows a diagrammatic representation of the clamp of FIG. 4A, except for the replacement of a lower clamping fixture with a block, use of spacer and a longer square head U bolt for more universal applicability.

FIG. 2 displays the mounted flotation device 40 divided into three distinct segments: the mounting bracket 50, the port side float unit 60 and the starboard side float unit 70.

The mounting bracket 50 can be divided into two distinct parts, the transverse support strut 80, and two clamps 90, one for each contact point between the transverse support strut 80, and the port and starboard gunwales 20,30 of T-shaped or inverted L-shaped design. These clamps 90 are used to firmly attach the transverse support strut 80 to the port and starboard gunwales 20,30 of the small watercraft 10.

In FIGS. 3, 4A, 4B, 5A & 5B, a lower clamping fixture 130 which tends to properly align the assembled and installed clamp 90 to the gunwale 20,30, is fitted to each of the square head U bolts 100 followed by two spacers 145 or flat washers 140, two lock washers 150, two fasteners, such as wing nuts 160 and two slide stops 170.

With the lower clamping fixtures 130, or block 180, spacers 145, flat washers 140, lock washers 150 and the wing nuts 160 at the lower extremity of the square head U bolts 100, the lower clamping fixtures 130 or block 180 are spread laterally and the entire mounting bracket 50 (FIG. 2) lowered onto the gunwales 20,30 of the small watercraft 10 and the lower clamping fixtures 130 (FIG. 4A) or block 180 (FIG. 43) are then released. The wing nuts 160, lock washers 150, flat washers 140 and the lower clamping fixtures 130 or block 180 are slid up the square head U bolts 103 until the square head U bolt 100 threads are properly engaged by the wing nuts 160.

When all four wing nuts 160 are engaged, but not yet secured, the clamp-locking safety cables 120 are then slid down each pair of the relevant square head U bolt 100 legs to the lowest point flush with the gunwale 20,30 upper surface via the pull tabs located on either side of the clamp-locking safety cable 120, and are thus engaged.

Final alignment of the mounting bracket 50 (FIG. 2) on the small watercraft 10 is then performed.

The lower clamping fixtures 130 (FIG. 5A) are gently pulled in toward the vertical edge of the gunwale 20,30 and all four wing nuts 160 tightened securely.

Figure 5A:
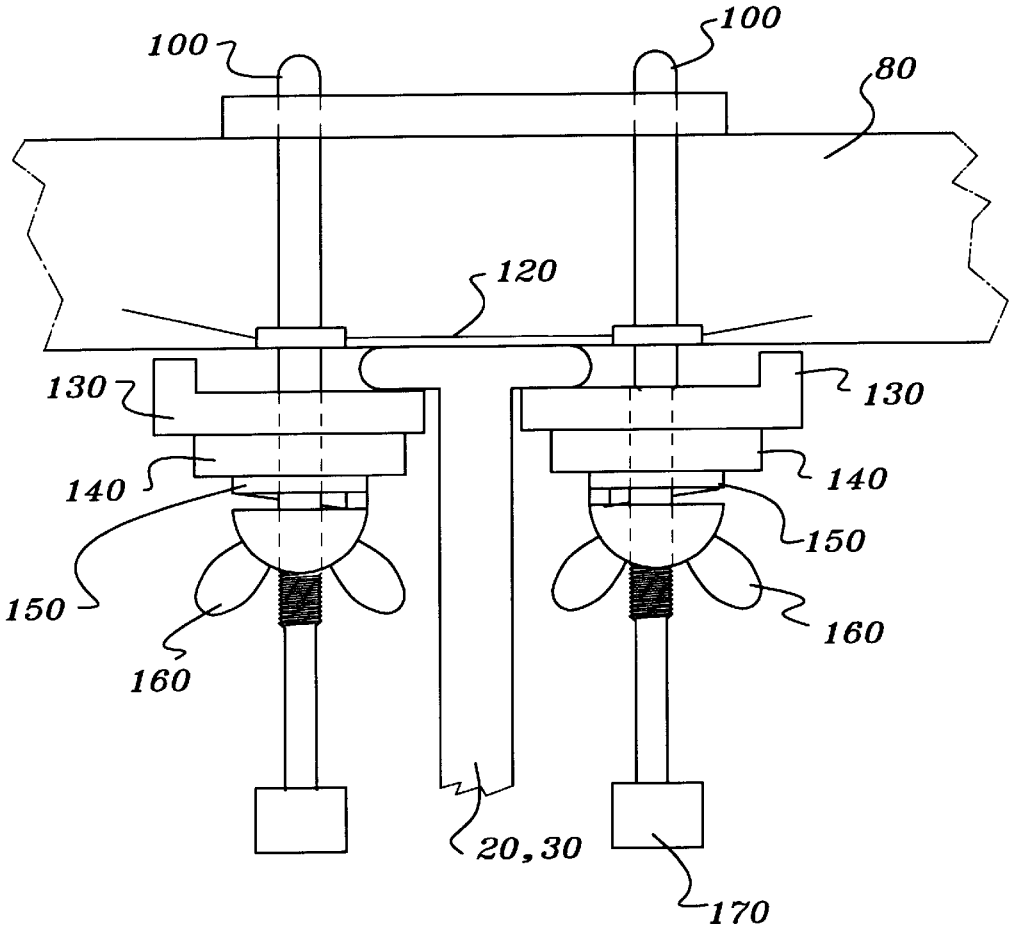
FIG. 5A shows a diagrammatic representation of an expanded view of the clamp utilized to fix the transverse support strut to the T-shaped gunwale of a small watercraft. The totally engaged and locked clamp is illustrated.
Figure 5B:
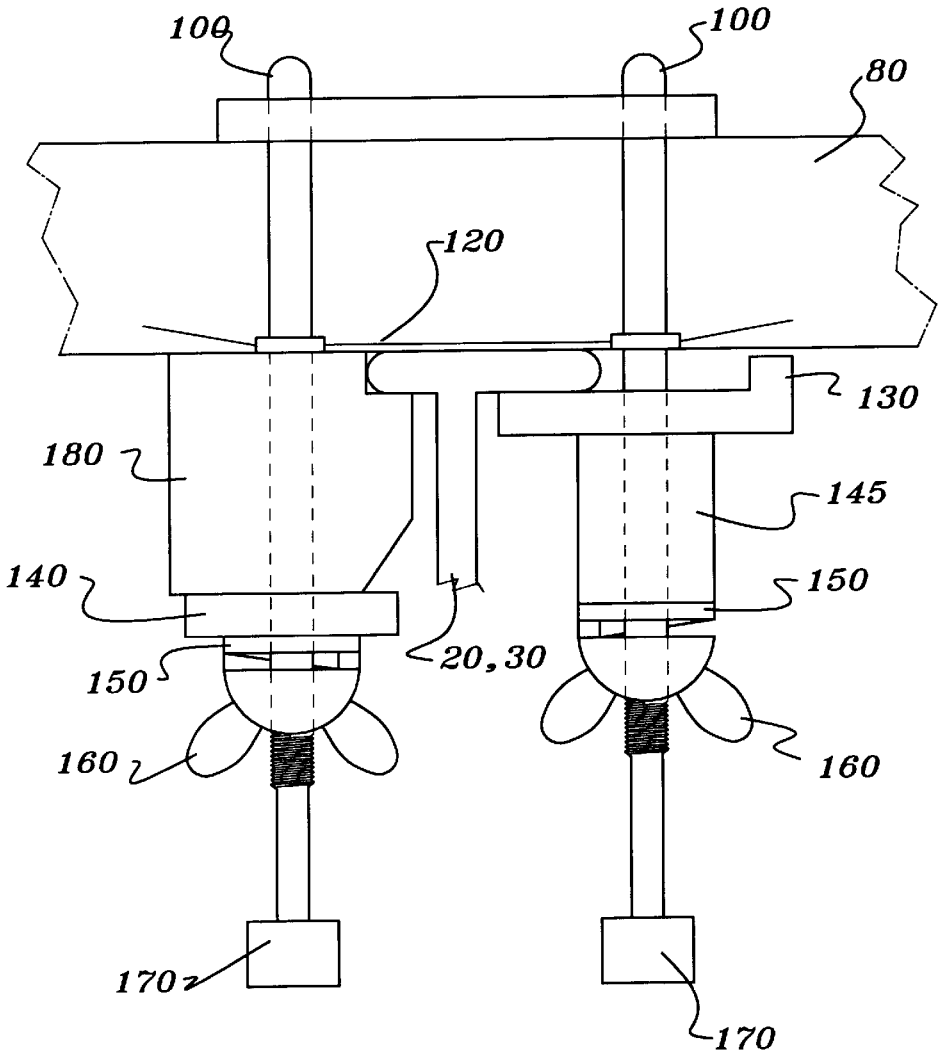
FIG. 5B shows a diagrammatic representation of the clamp of FIG. 5A and includes the same changes that are indicated in FIG. 4B h)

FIGS. 5A and 5B illustrate the clamp 90 once it is tightened securely. The clamp 90 design provides for rapid mounting and dismounting of the mounting bracket 50 (FIG. 2) on a small watercraft 10 with a T-shaped gunwale 20,30.

Figure 6A:
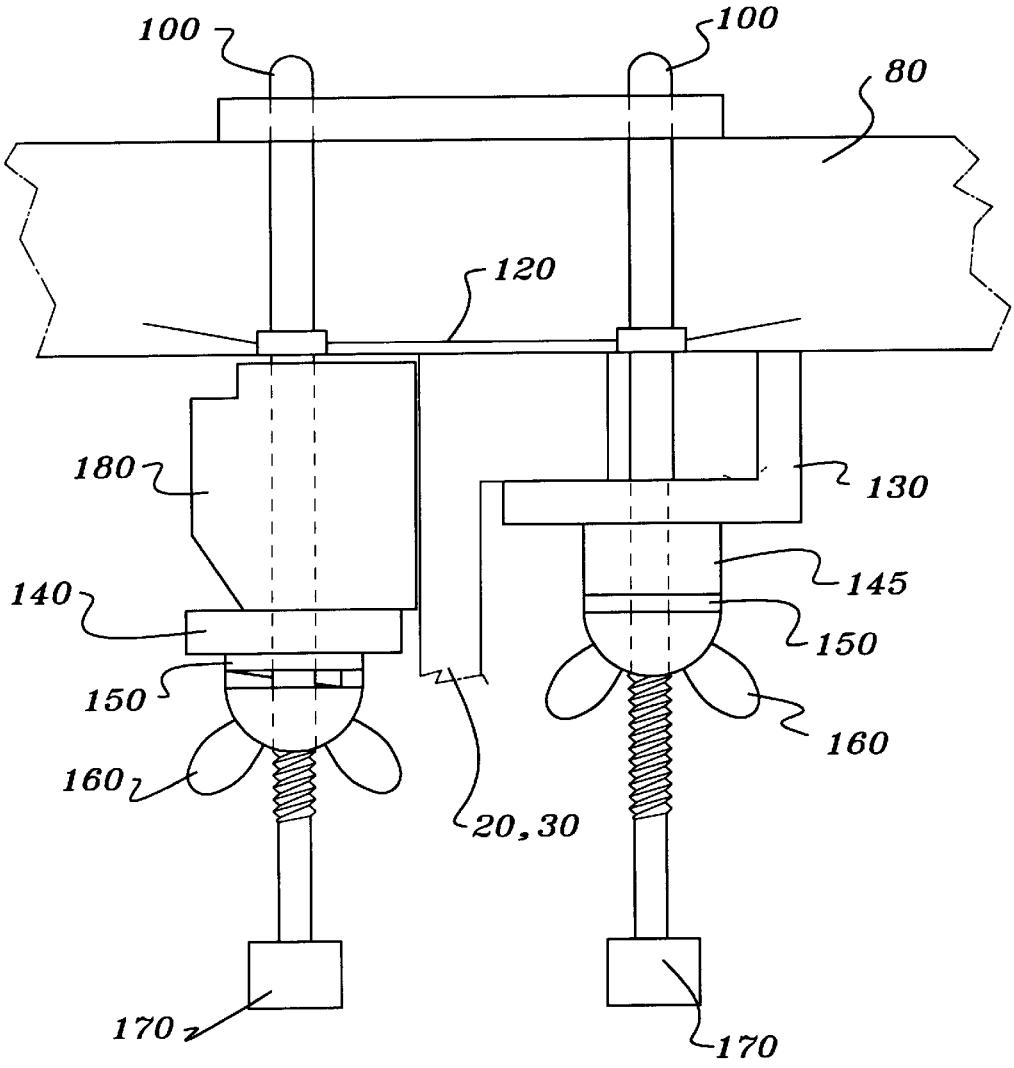
FIG. 6A shows a diagrammatic representation of an expanded view of the clamp utilized to fix the transverse support strut to the inverted L-shaped gunwale of a small watercraft. The totally engaged and locked clamp is illustrated.
Figure 6B:
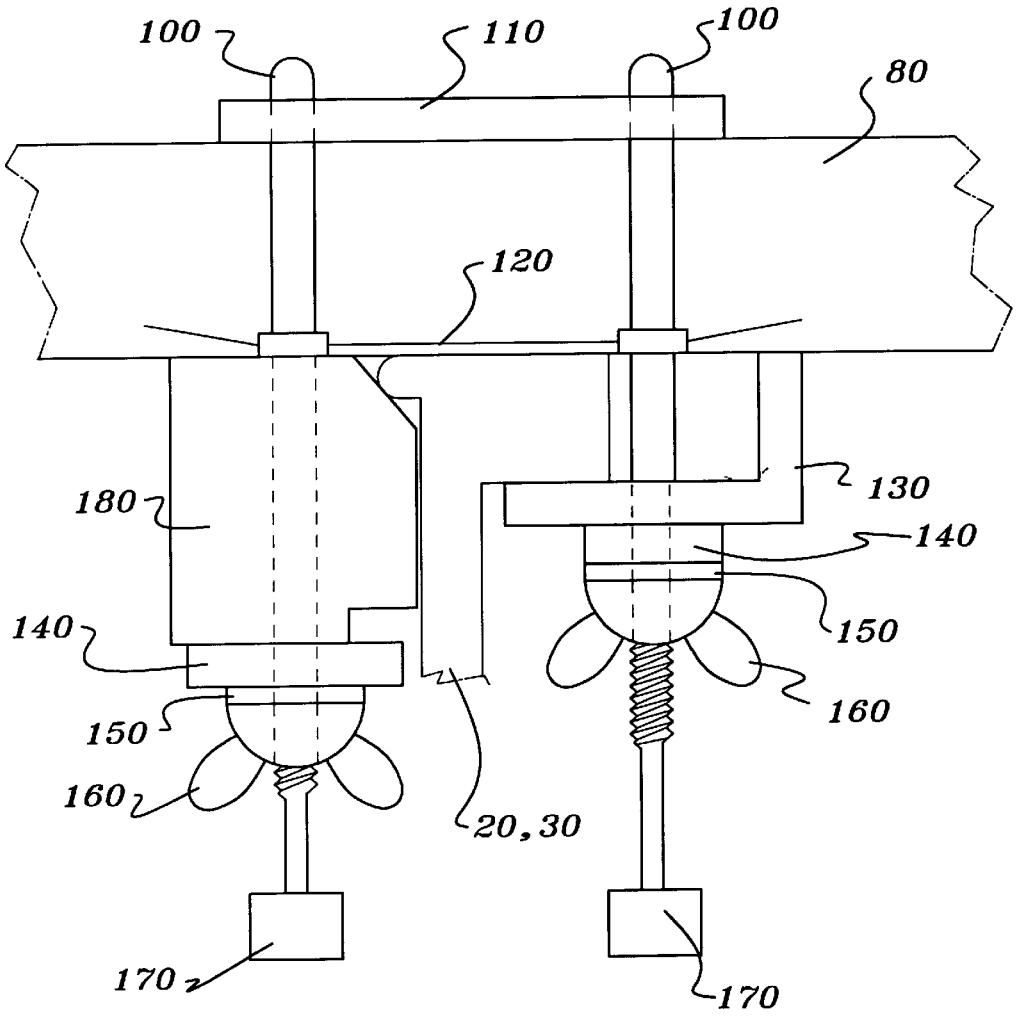
FIG. 6B shows a diagrammatic representation of the clamp of FIG. 6A except for the rotation of the block to accommodate a slight variation in the shape of the inverted L-shaped gunwale.

In FIGS. 6A and 6B a variation on the clamp 90 design permits its use on the hulls of small watercraft 10, (FIG. 2) which possess inverted L-shaped gunwales 20,30. In the modification, one of the lower clamping fixtures 130 is replaced with a suitable block 180 of metal, wood, or engineering plastic. The block (18) can be coated with rubber or soft plastic to prevent marring of the gunwale 20,30 and hull of the small watercraft 10 (FIG. 2). The relative dimensions of the block 180 are indicated, with a length similar to that of the lower clamping fixture 130 which is attached to this clamp 90. The block 180 is, therefore, defined as modified version of the lower clamping fixture 130.

The block 180 may be chamfered or contour shaped to better accommodate the shape of the gunwale 20,30 and hull of the small watercraft 10 (FIG. 2). The block 180 (FIGS. 6A & 6B) fitted to the clamp 90 on an inverted L-shaped gunwale 20,30 does not necessarily contribute substantially to the clamping force on the gunwale 20,30.

It does minimize leveraged torsional motion, in the horizontal plane, of the mounting bracket 50 (FIG. 2) about the center of the clamp 90 on the opposing side of the gunwale 20,30. This is especially true in the case where the lower clamping fixture 130 becomes inadvertently loose. Thus, the affected side of the mounting bracket 50 (FIG. 2) may shift vertically, and vibrate or rattle, but there will be minimal torsional shifting of the mounting bracket 50.

The inability of the lower clamping fixture 130 (FIGS. 6A & 6B), which can be loose, and the block 180, which is tight, or vice versa, to splay apart sufficiently to totally detach the mounting bracket 50 (FIG. 2), from the gunwale 20,30 of the small watercraft 10 is due mainly to the clamp-locking safety cable 120 (FIGS. 6A & 6B) being in the engaged position. The lower clamping fixture 130 likewise, possesses the same mechanical characteristics as the block 180, but it also provides the substantial clamping force necessary to fix the mounting bracket 50 (FIG. 2) on the gunwale 20,30 of the small watercraft 10.

A mounting bracket 50 fixed with this clamp 90 can be rapidly attached to the inverted L-shaped gunwale 20,30 of a small watercraft 10 utilizing the same mechanical mounting technique as for the clamp 90 used with the T-shaped gunwales 20,30.

Figures 7A, 7B, 7C:
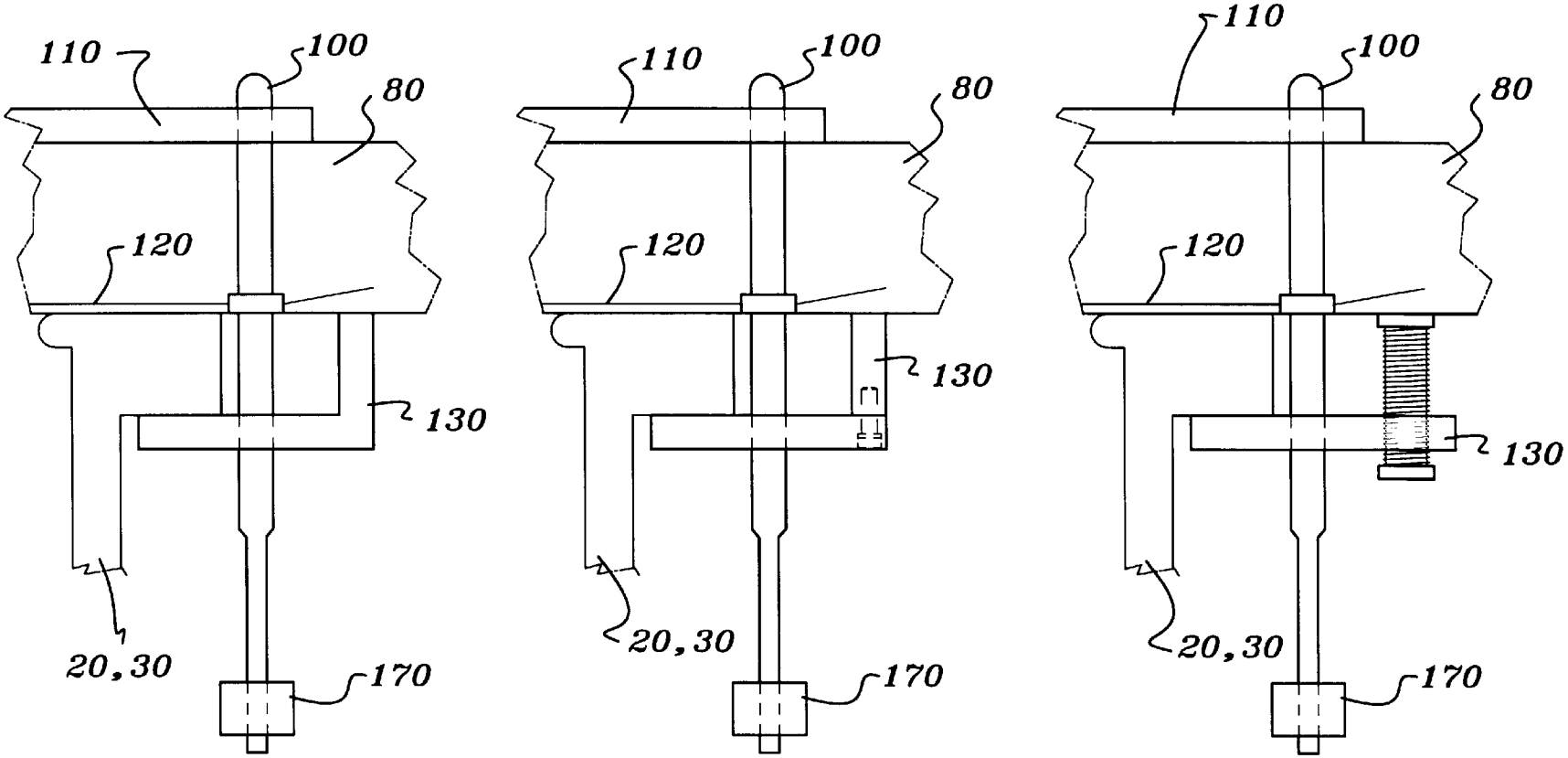
FIG. 7A shows a diagrammatic representation of the unit body type of lower clamping fixture that can be utilized as a component of the clamp.
FIG. 7B shows a diagrammatic representation of the assembly of component parts type of lower camping fixture that can be utilized as a component of the clamp.
FIG. 7C shows a diagrammatic representation of the adjustable type of lower clamping fixture that can be utilized as a component of the clamp.

The lower clamping fixture can be a unit body construction as shown in FIG. 7A, an assembly of component parts as shown in FIG. 7B or can be adjustable as shown in FIG. 7C to accommodate the different thicknesses of the clamping surface of different gunwales.

The mounting bracket 50 (FIG. 2) can be clamped firmly transversely at any desired longitudinal position on the small watercraft 10.

Figure 8:
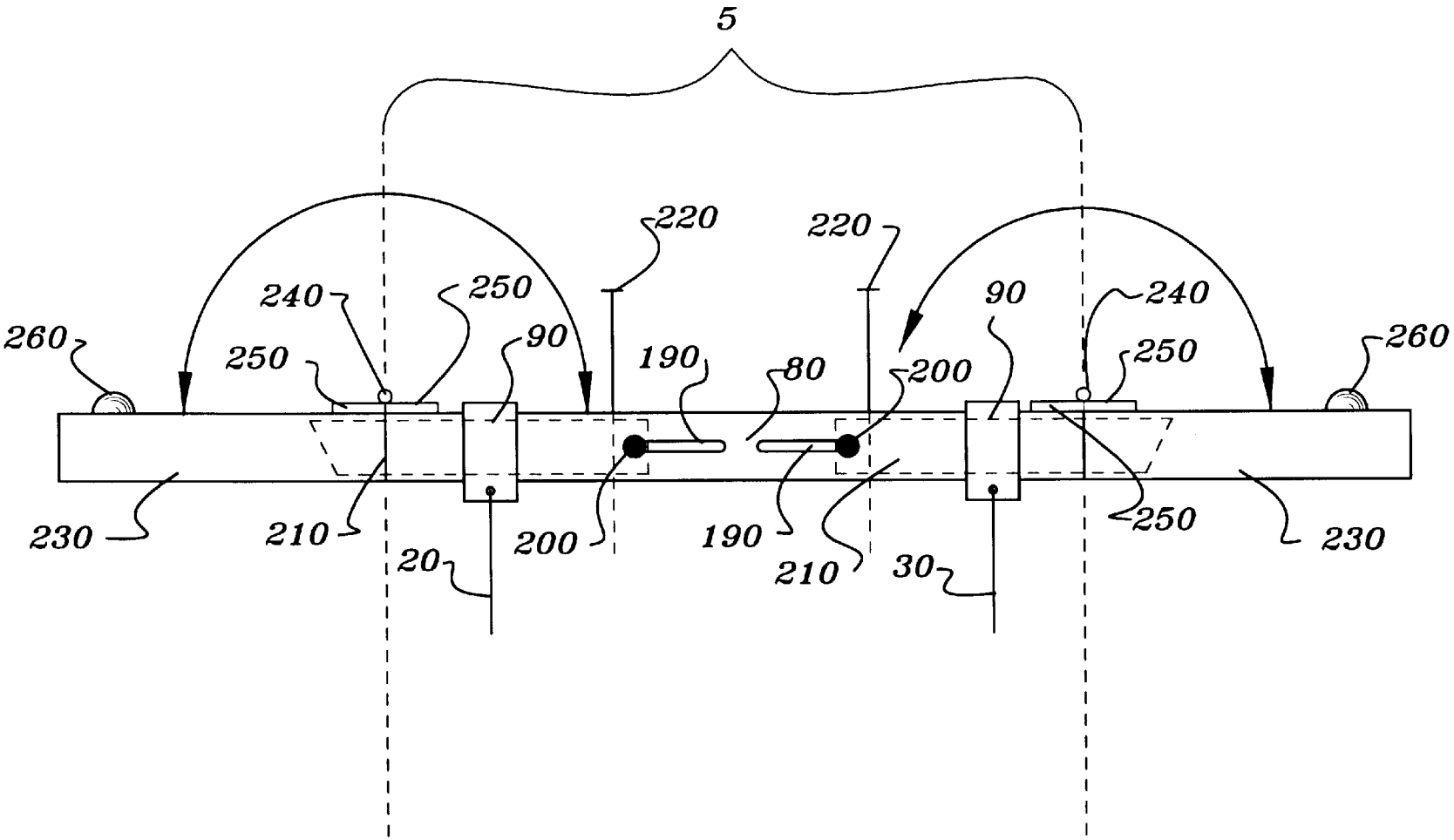
FIG. 8 shows a diagrammatic representation of a mounting bracket (expanded view, not to scale) from a perspective aft of the small watercraft. The geometric arrangement of the various components is displayed.

A preferred embodiment of the invention is illustrated in FIG. 8. The transverse support strut 80 is composed of high strength metal, alloy, carbon fibre, fibre resin, composite, or engineering plastic of suitable structural shape, such as square or rectangular tube.

A pair of slots 190 cut into the side of the transverse support strut 80 permit the insertion of the rotary, lock and release slide knob 200 through each slot 190. The rotary, lock and release slide knob 200 is firmly fastened to a locking strut 210 of suitable high strength tube, structural shape or solid bar stock.

A safety lock pin 220 can be inserted through a suitable hole drilled through the transverse support strut 80 and the locking strut 210 in both the engaged and disengaged positions.

The locking strut 210 should slide smoothly inside the transverse support strut 80 cavity with a length that is sufficient to engage and disengage the outer strut arms 230 and lock them in their proper positions. The locking strut 210 may be chamfered to aid in the proper alignment of the outer strut arm 230 relative to the transverse support strut 80, as illustrated in FIG. 8.

In FIG. 8 each end of the transverse support strut 80 is fitted with a hinge 240 between the gunwale 20,30 and the outer strut arms 230. The hinges 240 can be fixed to the transverse support strut 80 using any suitable technique, such as welding, or by drilling suitable holes and countersinking the inner surface. The hinge (240) can then be secured in position with flush mount rivets or flat head screws or other fasteners 250. These methods can provide a smooth bore surface for the locking strut 210 to slide through. Similarly the hinge 240 is also fixed to the outer strut arm 230. The swing of the folding or unfolding outer strut arm 230 can be damped utilizing one of the following three techniques:

First, the outer strut arm 230 with the attached accessory reaching the accessories engaged limit can be utilized to affect the damping or "SOFT" engagement of the outer strut arm 230 and attached accessory.

The second involves the hinged 240 area of the mounting bracket 50 being fitted with an elasticized shock cord or similar proprietary product (not shown), which is anchored to the transverse support strut 80 or the outer strut arm 230 on the one hand, and fixed either directly to the opposing arm or strut, or to an automatically engaged leverage arm that is swung into its engaged position on the other. This being done so that when the outer strut arm 230 is swung from the disengaged (stowed) configuration to the fully engaged configuration, or vice versa, the leverage arm can be pivoted into its engaged position which allows the shock cord to tighten and result in a damped and "soft" engagement or disengagement of the outer strut arm 230.

The third alternative requires that a suitably tensioned spring (not shown) be fixed to, or is an integral part of the hinge 240. The spring can effect leveraged damping of the outer strut arm 230 being swung into the engaged or the stowed configuration.

When each of the outer strut arms 230 are in the engaged position, they are securely locked in position by the locking strut 210. When the outer strut arms 230 are extended the rotary, lock and release slide knobs 200 are loosened and slid outward to the extreme end of the slots 190 on the transverse support strut 80 and re-tightened, thereby locking the locking struts 210 in the engaged position.

The safety lock pin 220 can then be inserted as a safety lock, to ensure that the outer strut arms remain engaged. Either one or both of the outer strut arms 230 can be engaged or stowed at any point. When an outer strut arm 230 is being folded from the engaged to the stowed position, the shock bumper 260 reduces the possible jarring vibrations throughout the small watercraft 10, (FIG. 2).

Figure 9A:
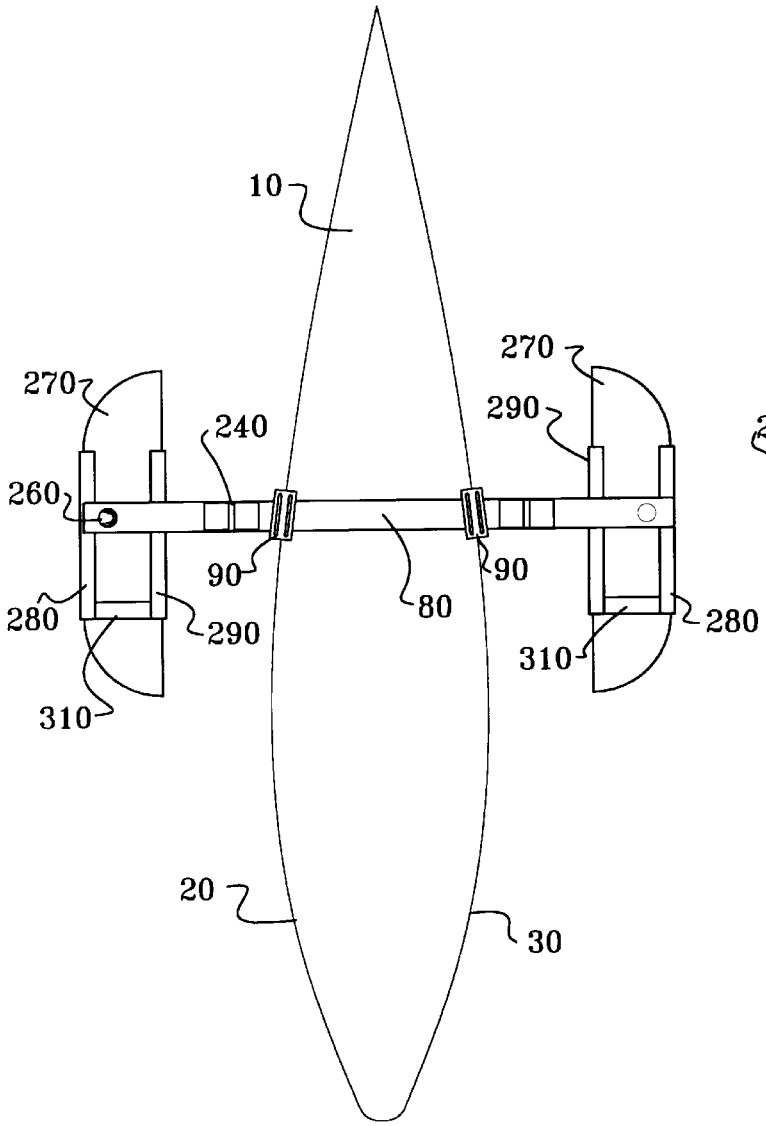
FIGS. 9A and 9B show a diagrammatic representation of a flotation device fixed to a small watercraft via the mounting bracket with fold-able outer strut arms. Both outer strut arms and therefore both float units are in the engaged configuration.
Figure 9B:
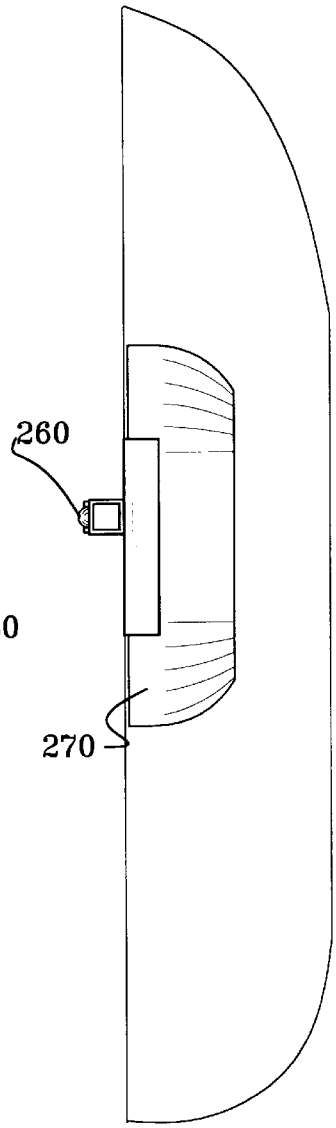

FIG. 8 in conjunction with FIGS. 9A and 9B illustrate some functional characteristics which are designed into the mounting bracket 50 when it is mounted on a small watercraft 10. The transverse support strut 80, clamps 90, outer strut arms 230, hinges 240, shock bumpers 260 are the primary components of the mounting bracket 50 which are displayed in a typically useful geometric configuration on a small watercraft 10.

Although the invention presented here is developed for use with small watercraft, portions of this invention can be utilized quite effectively with other watercraft. The clamp 90 or mounting bracket 50 can be extremely useful on larger beam watercraft. The mounting bracket and clamps can be readily fitted to any watercraft, which possesses a T-shaped or inverted L-shaped gunwale, to provide a portable and heavy-duty mount for other accessories (such as a sailing conversion kit) which could be very useful on the larger watercraft.

Finally, either the accessories or the mounting bracket utilized to mount the accessories can be designed with a deliberately breakable component (frangible link), such as the clamp fasteners, which will sheer under Levels of stress which are slightly below those at which the gunwale or hull of the watercraft will be irreparably damaged. The accessory will thus break away and detach from the watercraft before irreparable damage can occur.

The inventor has given a non-limiting description of this invention. Many possible variations in design details and materials can alter the appearance and the manufacturing costs of the device without any real change to its function. Due to the simplicity and elegance of the design of this invention designing around it is very difficult if not impossible. Nonetheless many changes may be made to this design without deviating from the spirit of this invention. Examples of such contemplated variations include the following:

1. The shape and size of the various members and components may be modified.
2. The color, aesthetics and materials may be varied.
3. A different type of fastener or folding may be used.

4. Additional complimentary and complementary functions and features may be added.

5. The transverse support strut member may be interfaced to the watercraft differently.

6. Folding may be performed differently.

Other changes such as aesthetics and substitution of newer materials as they become available, which substantially perform the same function in substantially the same manner with substantially the same result without deviating from the spirit of the invention may be made.

Following is a listing of the components used in this embodiment arranged in ascending order of the reference numerals for ready reference of the reader.

10=Watercraft generally

20=Port side gunwale of small watercraft

30=Starboard side gunwale of small watercraft

40=Flotation device

50=Mounting Bracket

60=Port side float unit

70=Star board side float unit

80=Transverse support strut.

90=Clamp

100=Fasteners such as cup square carriage bolts or square head U bolts

110=Top alignment fixture

120=Clamp locking safety cables or straps

130=Lower clamping fixture

140=Washer

145=Spacer

150=Lock washer

160=Wing nut

170=Slide stop

180=The block

190=Slot

200=Rotary lock & release slide knob

210=Locking strut

220=Safety lock pin

230=Outer strut arm

240=Hinge

250=Fastener

260=Shock bumper

270=Float

280=First bracket—outer strut arm interface to float

290=Second bracket—outer strut arm interface to float

310=Third bracket—outer strut arm interface to float

DEFINITIONS AND ACRONYMS

A great care has been taken to use words with their conventional dictionary definitions. Following definitions are included here for clarification.

3D=Three Dimensional

BOW=Front of a watercraft

Gunwale=The upper edge of the watercraft

DIY=Do It Yourself

Integrated=Combination of two entities to act like one

Interface=Junction between two dissimilar entities

Port Side=Side of watercraft facing the land

Starboard side=Side of the watercraft facing the water.

Stern=The rear of a watercraft

Symmetrical=The shape of an object or integrated entity which can be divided into two along some axis through the object or the integrated entity such that the two halves form mirror image of each other.

Unitary=A design of a single integrated unit.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefore contemplated that the appended claim(s) cover any such modifications, embodiments as fall within the true scope of this invention.

The Inventor claims:

1. A universal small watercraft clamp comprising:

a) a transverse support member mounted on to a watercraft;

b) a pair of fulcrums in said transverse support member;

c) means for mounting said transverse support member on the gunwale of said watercraft;

d) a pair of locking means for locking said transport support member in position e) a lower clamping fixture connected to said transverse support member.

2. The universal small watercraft clamp of claim 1 wherein said clamp includes an adjustable lower clamping fixture.

3. The universal small watercraft clamp of claim 1 wherein the gunwale of said watercraft is T-shaped.

4. The universal small watercraft claim of claim 1 wherein the gunwale of said watercraft is inverted L-shaped.

5. A method of clamping a pair of flotation devices to a small watercraft comprising mounting a lockable transverse support member having a pair of fulcrums on to the gunwale of a small watercraft and which further includes an adjustable lower clamping fixture.

* * * * *